United States Patent [19]

Rosen

[11] Patent Number: 5,060,402

[45] Date of Patent: Oct. 29, 1991

[54] ADJUSTABLE GIRTH SHOE CONSTRUCTION

[76] Inventor: Henri E. Rosen, 229 Coolidge Ave., Watertown, Mass. 02172

[21] Appl. No.: 441,978

[22] Filed: Nov. 28, 1989

Related U.S. Application Data

[63] Continuation-in-part of Ser. No. 312,668, Feb. 17, 1989, abandoned.

[51] Int. Cl.[5] ..... A43B 3/26

[52] U.S. Cl. ..... 36/97; 36/55; 36/93

[58] Field of Search ..... 36/93, 55, 97, 58.5, 36/10, 88, 9 R; 128/615

[56] References Cited

U.S. PATENT DOCUMENTS

| | | | |
|---|---|---|---|
| 2,550,334 | 4/1951 | Dahlhouser | 36/9 R |
| 2,845,723 | 8/1958 | Arnold | 36/9 R |
| 3,015,170 | 1/1962 | Kramer | 36/9 R |
| 3,063,074 | 11/1962 | Scholl | 36/9 R |
| 3,093,916 | 6/1963 | Hiestand et al. | 36/9 R |
| 3,120,711 | 2/1964 | Scholl | 36/9 R |
| 3,404,468 | 10/1968 | Rosen | 36/97 X |
| 3,436,842 | 4/1969 | Sachs | 36/97 |
| 3,541,708 | 11/1970 | Rosen | 36/97 |
| 3,686,777 | 8/1972 | Rosen | 36/97 |
| 3,748,756 | 7/1973 | White | 36/69 X |

*Primary Examiner*—Paul T. Sewell
*Assistant Examiner*—Ted Kavanaugh
*Attorney, Agent, or Firm*—Bruce F. Jacobs

[57] ABSTRACT

Footwear having a concealed means for girth adjustment is described. The girth adjustment means may be manual or automatic and generally comprises a girth adjustable lining assembly disposed within the shoe.

22 Claims, 7 Drawing Sheets

ADJUSTABLE GIRTH SHOE CONSTRUCTION

BACKGROUND OF THE INVENTION

In order for a shoe to fit properly, it should not only be of the correct length, but also should have inside width and girth dimensions that substantially continually match those of the foot therein. As used herein, girth is defined as the transverse circumference around the foot, typically measured at the ball, waist and instep thereof, and is also used to describe the effective inside circumference of the shoe in the same regions. In conventional footwear, such proper fit is approached only by offering a full range of some nine or more successively graduated width increments for each size in length. However, even with such full width ranges, some means of further girth adjustment is still needed to accommodate differences between left and right foot girths as well as those caused by diurnal and other girth variations experienced by the foot, which variations, primarily due to fluid accumulation in the foot, usually amount to up one and one half or even two full width sizes in range. Despite this well known information, the economics of mass production and distribution have brought about the widespread practice of limiting most shoe offerings to a single width for each size in length, resulting in only an approximate and usually poor fit in most cases, often resulting in serious foot disorders over time.

For these reasons, there has been a continuing need for a practical and economical shoe construction affording width and girth adjustment through means that are relatively concealed to allow such adjustability to be applied to a wide variety of shoe styles including those with conventional bottoms and attachment of uppers thereto.

Adjustable girth footwear is not new; much prior art has employed visible means of girth adjustment including laces, straps and the like, most of which are rarely adaptable to girth adjustment at the ball of the foot, where such adjustment is most needed. Moreover, these means are not even present in styles having typically no such girth adjustment means, such as loafers, women's dress shoes of various heel heights, and many other casual and boot styles; in addition, there are well-defined needs for footwear having means of girth adjustment that are automatic, not only to prevent improper manual adjustment, but to provide such adjustment to those who might otherwise have difficulty with other manual means, as for example, young children, the handicapped, and the elderly.

Adjustable girth footwear are also disclosed in U.S. Pat. Nos. 3,404,468, 3,541,708, and 3,686,777 granted this inventor. None of these proved marketable for several reasons: the latter patents were too complex to be able to be produced competitively, and were prone to malfunction as a result of dirt entrapment in the mechanism, while he embodiments of '468 suffered from similar problems, as well as durability and appearance compared to conventional shoes, and finally, the last three figures of '468 (11 through 13) failed to give sufficient girth adjustment to be worth consideration. However, despite their many shortcomings, they did serve to suggest the merit of the considerable added R&D that has led finally to the present invention.

U.S. Pat. Nos. 3,442,031 and 3,922,800 disclose shoes in which the girth is adjusted by raising at least part of the top surface of the insole, thereby not only changing the shoe's girth but the elevation of a foot in the shoe as well. Since, as a practical matter, such adjustment would usually take place in the forepart of the shoe to preserve a comfortable fit in the counter and backpart, there results an imbalanced adjustment that can change the effective 'tread' of the shoe, i.e. the relationship of the height of the wearer's heel to that of the ball. Moreover since proper adjustment of girth normally reflects the usual girth difference between left and right foot, another result would often be to have a person's feet at essentially different heights above the walking surface, which could over time result in serious orthopedic problems.

U.S. Pat. Nos. 490,998; 2,691,227 and 3,436,842, while apparently having some similarity to this invention are actually quite different in function, providing a measure of girth adjustment only when the shoe is unweighted while the present invention provides girth adjustment in both unweighted and weightbearing conditions, the latter being considered as far more important as the discomfort and trauma experienced with ill-fitting shoes occurs mainly under weight-bearing conditions. Furthermore, the latter two patents disclose no means to prevent entrapment of dirt and pebbles within the described structure.

U.S. Pat. No. 3,693,270 uses deformable sponges that are secured to the inside of a boot primarily to facilitate insertion and removal of the foot without the use of a zipper or other enlarging means. However, the heat and pressure build-up experienced with such inserts, particularly those worn over the foot in the ball area, has precluded their use in conventional dress and casual footwear.

U.S. Pat. No. 4,736,531 describes a shoe with a partial elastic slipper sock surrounding the forepart of the foot and fastened to the bottom assembly, free of attachment to the upper. While this structure may limit tongue misalignment in use, it affords no substantial girth adjustment as the narrower foot in such a shoe would typically experience looseness and resultant buckling when weight bearing during the stride cycle over the sensitive top area of the ball of the foot, where the foot flexes in motion.

U.S. Pat. No. 4,038,762 discloses use of viscous flowable materials within closures, primarily for use in alpine ski boots having rigid soles, and as described, is not applicable to conventional footwear which optimally requires girth adjustability at the ball of the foot, where the MP (metatarsal/phalange) joints flex during the gait cycle. This, and similar approaches using air, gels, gas, plastic foam, and other mechanical means, while useful in rigid-soled footwear particularly when used rearward of the ball have generally been precluded from use at or over the ball, primarily for comfort and foot health considerations in this relatively sensitive and critical fitting area.

SUMMARY OF THE INVENTION

The present invention has as its principal object the construction of a shoe containing a substantially concealed girth adjustment means for use with a wide variety of shoe styles, including those having conventional bottom elements.

The shoe of the present invention comprises a deformable upper, the lower margins of which are inelastically fastened to a sole or sole assembly, and a girth adjustment means disposed within the cavity defined by said upper and sole elements. The girth adjustment means is preferably in the form of an inner liner assembly. It is attached to the uppermost interior portions of the upper, and includes elastic means that enable it to adjust its girth to that of a foot therein, while deforming the sides of the upper as may be needed to accommodate this adjustment. In the preferred embodiments, such deformation in the upper, as may accompany this adjustment, occurs only when the shoe is weight-bearing, and mostly when it is in motion and thus least noticeable visually.

In one embodiment, the inner liner assembly includes relatively non-stretchable lining elements around the sides of the foot, attached to a panel of stretchable material under the foot, with a floating insole between the foot and the panel.

In another embodiment, the functions of the inner assembly elements are essentially reversed, with the stretchable material being located along the sides of the shoe and the nonstretchable material comprising the bottom panel.

In a further embodiment, not shown in the drawings, a stretchable liner assembly extends fully around the sides and under the bottom of the foot. Such a construction is particularly suitable for footwear of the so-called 'tubular' construction.

In other embodiments, the girth adjustment means include an inner assembly having having relatively girthwise nonstretchable lining elements attached to insole assembly (covering) elements, with both preferably attached to a transversely adjustable frame assembly. The frame assembly preferably, but not necessarily, is interconnected by hinge-like bridging portions, and has attached thereto any of the various adjustment means including springs, other elastic materials, cables, cams and the like. Transverse motion in the frame assembly results in a rolling adjustment to the side margins of the liner elements and consequent effective girth dimensional change of the inner liner assembly. In all these latter embodiments, the insole portion of the unweighted inner assembly is at least partially suspended within the shoe, with deformation of the upper occurring only at such times as the shoe becomes weightbearing. At all other times, the upper will retain the original lasted contours of the shoe, irrespective of the girth of the foot therein.

In still other embodiments, particularly those designed for use in lower cost footwear, the concealed girth adjustment means comprises stretchable lining elements, partially attached directly to the uppers in such a fashion as to allow the uppers to assume, when needed, somewhat different transverse contours as compared to those of the inside stretchable adjustable surface of the lining elements as they adjust to conform and adjust girthwise to the contours and dimensions of a foot therein. These latter embodiments are preferably used in conjunction with the simple and conventional fixed attachment of upper and lining elements to bottom elements along their mutually adjacent marginal edges.

For a fuller understanding of the nature and objects of the present invention, reference should be made to the following detailed description taken in connection with the accompanying drawings.

DETAILED DESCRIPTION OF THE INVENTION

Figure 1:
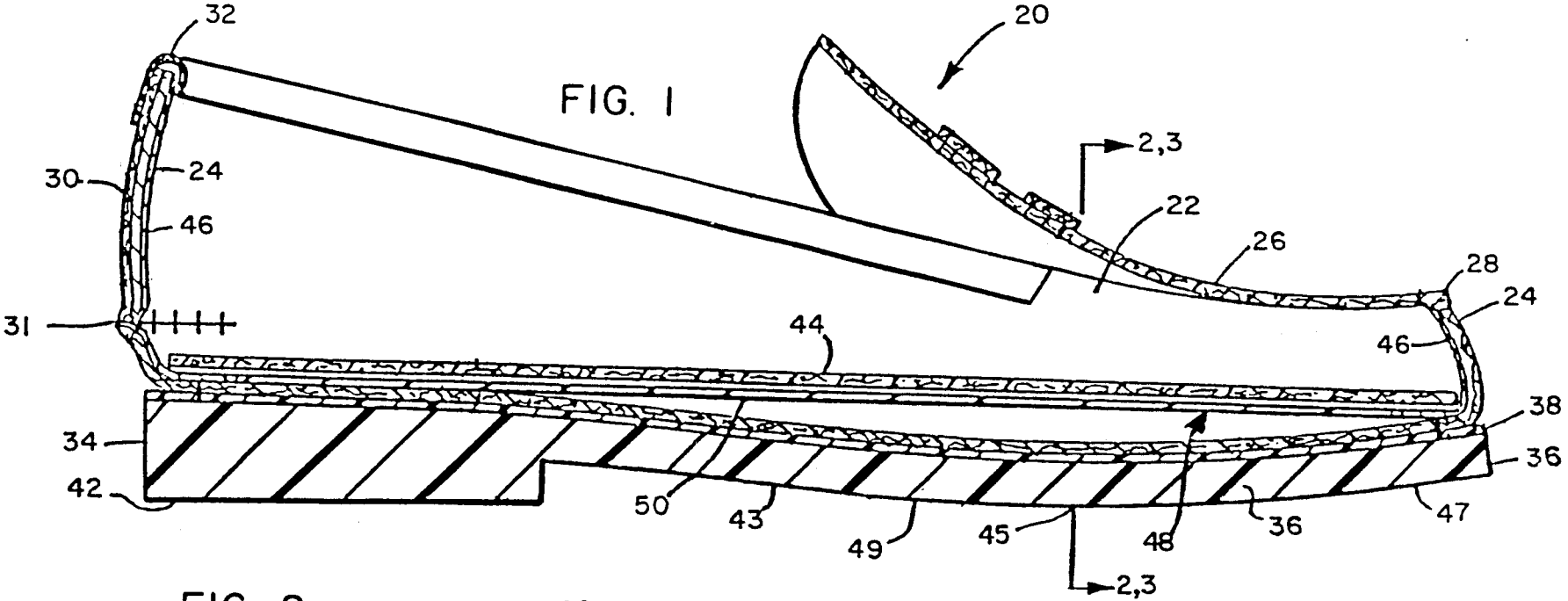
FIG. 1, is a side-elevational cross-sectional view of a shoe embodying the principles of the present invention.

Referring to the drawings, the adjustable girth shoe construction of the present invention will be described with reference to the well known 'loafer' design. It should, however, be understood that this is being done for ease of reference and that the invention is not limited to any one style of shoe, but rather is applicable to most other types of footwear including other styles of shoes, boots, sneakers and slippers. In the various embodiments described hereinafter, like reference numerals refer to like members which function in the same or similar manner.

Figure 2:
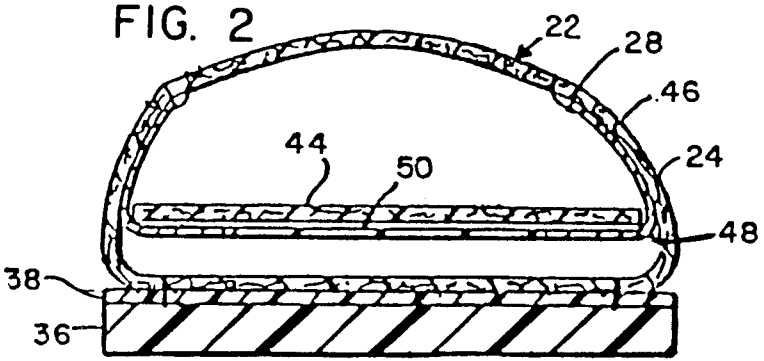
FIG. 2 is a transverse cross-sectional view of the shoe of FIG. 1 taken along line 2—2 in the latter, with the shoe off the foot.
Figure 3:
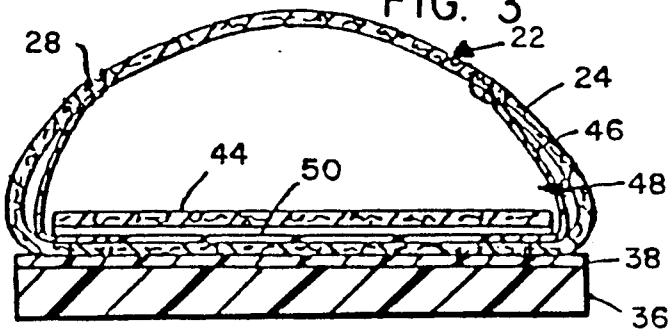
FIG. 3 is a view of the embodiment of FIG. 2, shown as if the shoe is on the foot, and at least partly weight-bearing.

Referring to FIGS. 1-3, there is shown one embodiment of the present invention. Shoe 20 comprises a typical flexible upper 22, preferably composed of leather, including vamp 24 and plug 26 joined together by a suitable means such as stitching so as to form a seam 28 extending around the forepart of the shoe. The back portion of the shoe has the usual counter pocket or back tab 30 over vamp 24, a collar or cuff 32 preferably stitched to cover the adjacent top edges of tab 30, upper 22 and liner 46. Shoe 20 also includes a typical conventional sole assembly 34 having a heel 42 instep 43, waist 49, ball 45 and toe 47. Sole assembly 34 in this embodiment is composed of a conventional rubber unitsole 36 preferably cut from a so-called "blocker", and a rubber midsole 38, attached on its bottom surface to the top surface of unitsole 36 by adhesive cement, or other suitable attachment means. Midsole 38 is joined, preferably by stitching about its periphery to the bottom portion of vamp 24. Shoe 20 also contains an adjustable inner assembly 48 comprising a liner 46 and a socklining 50. In this embodiment liner 46 is composed of a non-stretchable material, preferably Cambrelle®, a non-woven nylon fabric supplied by the Faytex Corp. of Braintree, Mass., but any other suitable substantially non-stretchable material may also be used. Liner 46 is attached at its uppermost margin to the matching edge margins of vamp 24, and lies otherwise free of vamp 24, except at the heel end where it has been optionally included in the handsewn backpart seam 31 fastening tab 30 and top and bottom sections of vamp 24 together. The elasticized socklining 50 is fastened by stitching within its bottom surface to liner 46 and together liner 46 and socklining 50 form the inner assembly 48 which surrounds the sides and bottom of the foot. Socklining 50 is preferably constructed of a stretch-knit fabric of the type known generally as spandex, although any other suitable elastic sheet material may be employed. Optionally, but preferably, an insole 44 lies loosely above the lower marginal edges of liner 46 and socklining 50. It protects socklining 50 and its sewn seam connection to liner 46 from undue wear, and the foot from feeling said sewn seam. Insole 44 preferably extends the length of the shoe interior, and is of a pattern matching the bottom of the maximum width last acceptable by the shoe; i.e., the last on which the shoe was made. In addition, insole 44, is unattached to the inner assembly 48 and is easily removable for cleaning and removal of any foreign matter that may have accumulated inside the shoe.

FIG. 2 shows shoe 20 with socklining 50 unstressed and insole 44 in suspension. In this condition, socklining 50 is at its minimum width, and consequently holds the bottom margins of liner 46 at their closest proximity to each other. In this noload condition, the contours of upper 22 tend to remain substantially as they were when on the last on which the shoe was made. On the other hand, when the shoe is on the foot and also weight-bearing as shown in FIG. 3, socklining 50 stretches to allow liner 46 to exactly fit the foot, particularly in the important fitting region between and including ball, waist and instep. As the inner assembly 48 increases to adapt itself to the girth of the foot, it becomes primarily responsible for the fit of the shoe on that foot. Moreover, when the shoe is weight-bearing as shown in FIG. 3 the sides of the upper 22 deform by a slight outward bulging as the inner assembly 48 and insole 44 move downwards under foot pressure, with the extent of such deformation being relative to the girth of the foot therein and limited to the greatest girth said shoe is designed to accommodate.

Figure 4:
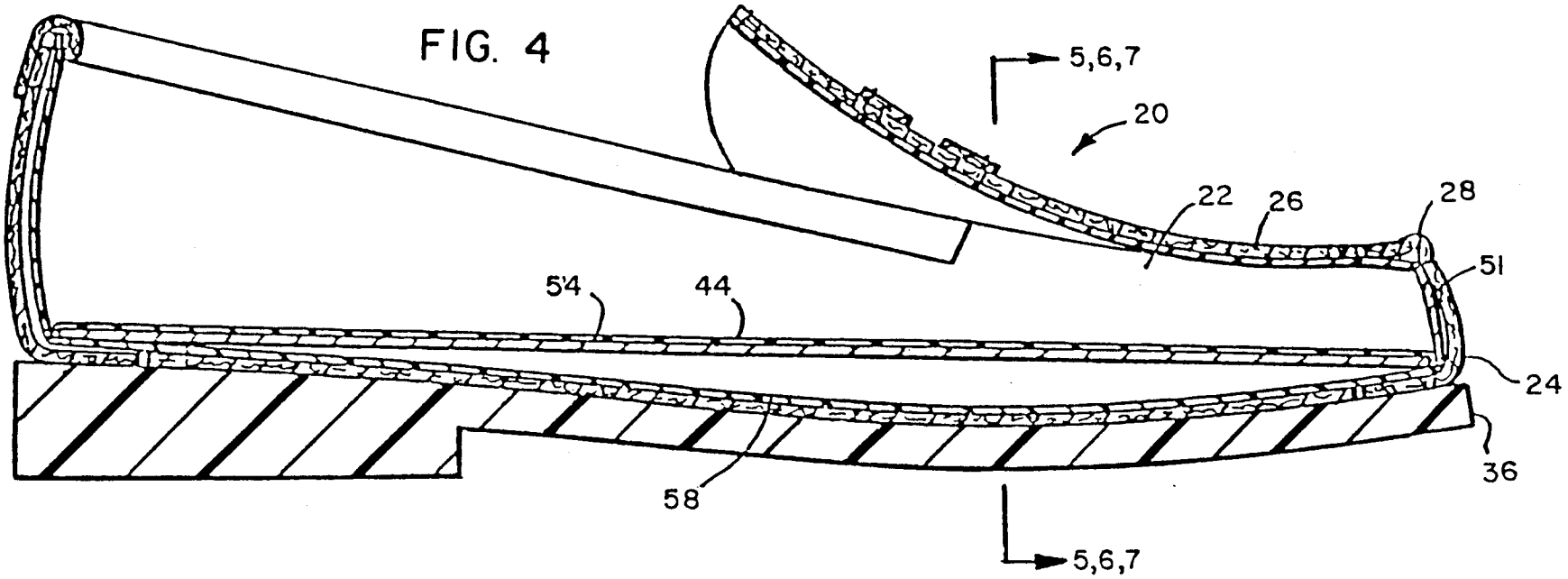
FIG. 4 is a side-elevational cross-sectional view of another embodiment of a shoe incorporating principles of the present invention.
Figure 6:
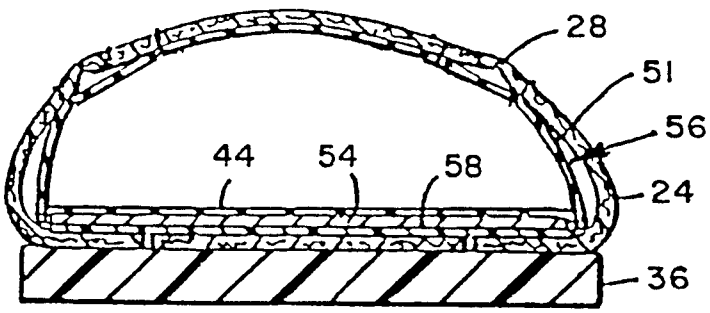
FIG. 6 is a view of the embodiment of FIG. 5, taken with the shoe on the foot and at least partially weight-bearing.
Figure 5:
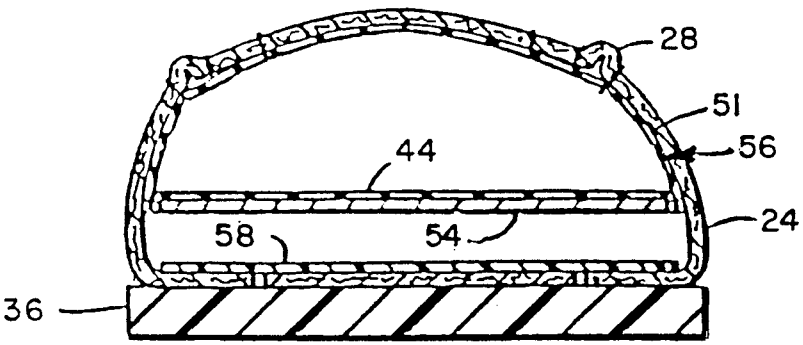
FIG. 5 is a cross-sectional view of the shoe of FIG. 4, taken along the line 5—5 in the latter, when off the foot.
Figure 7:
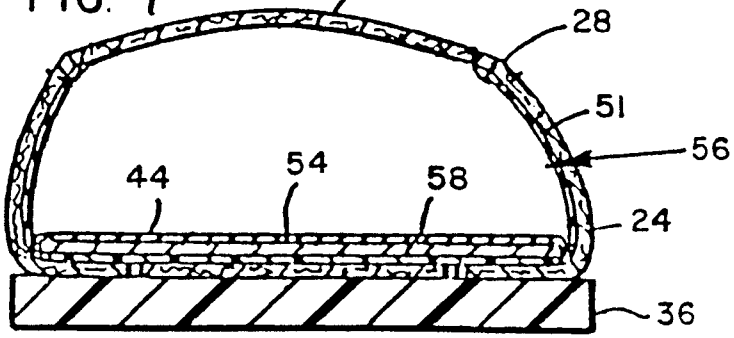
FIG. 7 is a side-elevational cross-sectional view of an alternative version of a shoe embodying the principles of the current invention.

FIGS. 4–7 show an embodiment similar to that shown in FIG. 1–3, except that here the action has been essentially reversed, in that the stretch material surrounds the sides and optionally also the top of the foot, while the non-stretch elements are underfoot. Thus FIG. 4 shows a simulated moccasin construction with upper 22 lasted over a permanent fixed insole 58, of Texon®, or similar conventional insole material with an inner assembly 56 comprising a spandex or similar stretch liner 51 attached, preferably by stitching, to a non-stretch socklining 44 of Cambrelle® or the like, which supports a non-stretchable insole 44. FIG. 4–6 show this embodiment in a simulated moccasin construction, wherein seam 28 is a simulated .seam, heat-formed in the one piece vamp 22 that now includes plug portion 26 therein. Such construction of seams or pleats can be carried out with equipment supplied by the Geo. Knight Co. of Brockton, Mass., and others. As best shown in FIGS. 4 and 5, the simulated seam 28 is stitched to liner 51 under essentially zero tension and in a non-extended condition. FIG. 6 shows the seam 28 and liner 51 to which it is sewn now in an expanded condition as would occur in a load-bearing condition with a relatively wide foot in the shoe. In addition, the upper 22 is deformed along its sides as shown in FIG. 3, as well as along the now expanded simulated seam 28. FIG. 5 shows the shoe off the foot, with the inner assembly 56 under zero or minimal tension. It should be understood that the simulated seam may be used together with the aforementioned girth adjustable inner assembly or alone to effect girth adjustment or left out as shown in FIG. 7, in which all girth adjustment results from the elasticity of the vamp lining assembly, together with the accompanying vamp side deformation previously described.

Figure 8:
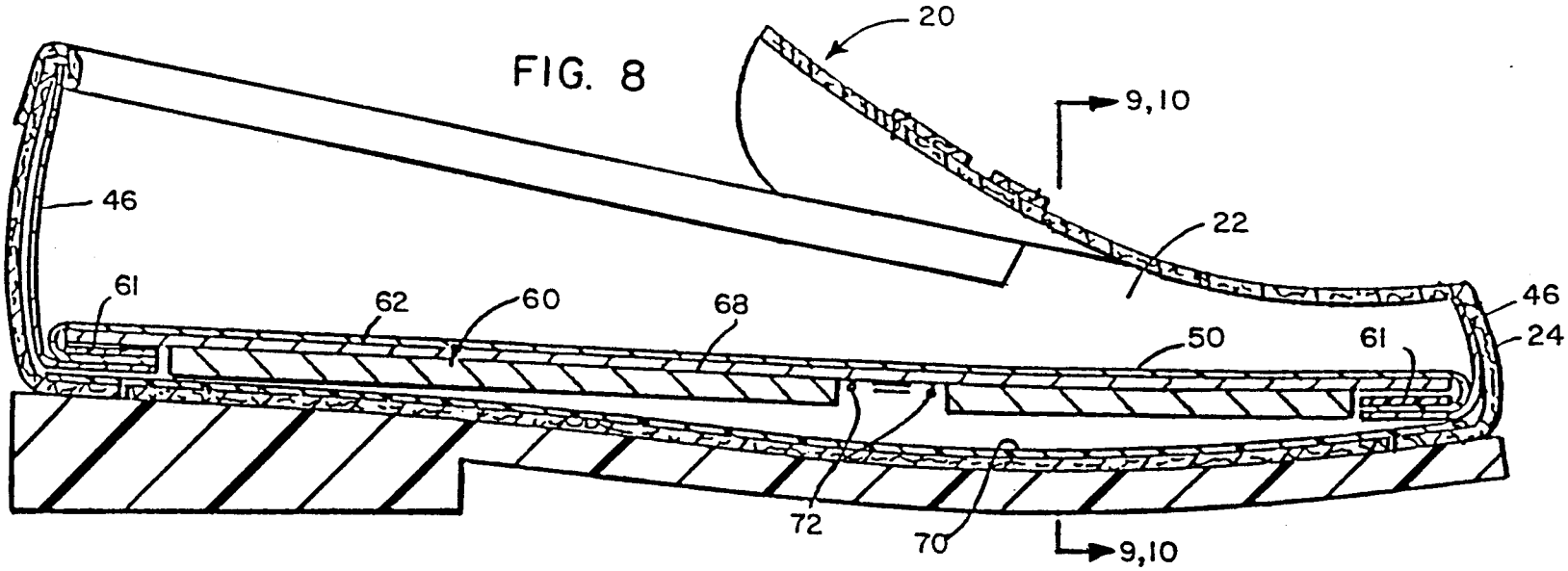
FIG. 8 is a side-elevational cross-sectional view of another preferred embodiment of the shoe incorporating principles of the present invention.
Figure 10:
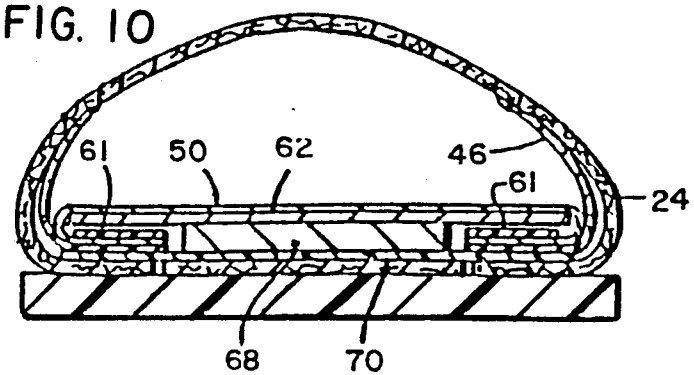
FIG. 10 is a cross-sectional view of the shoe of FIG. 8 taken along the line 10—10 thereof, and showing the shoe as it would appear when on a wearer's at least partially weight-bearing foot.
Figure 9:
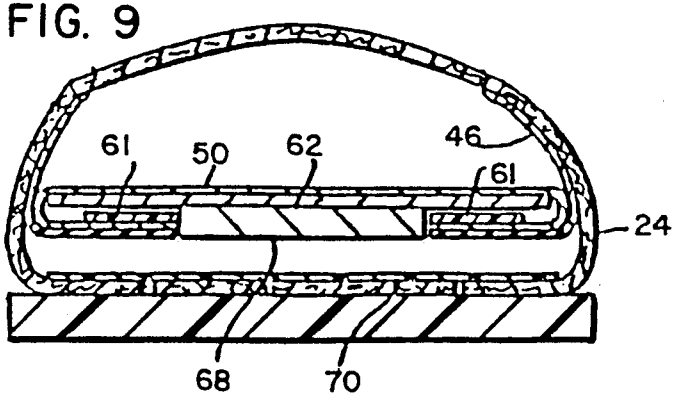
FIG. 9 is a cross-sectional view of the shoe of FIG. 8 taken along line the line 9—9 thereof and showing the shoe as it would appear off the foot.
Figure 11:
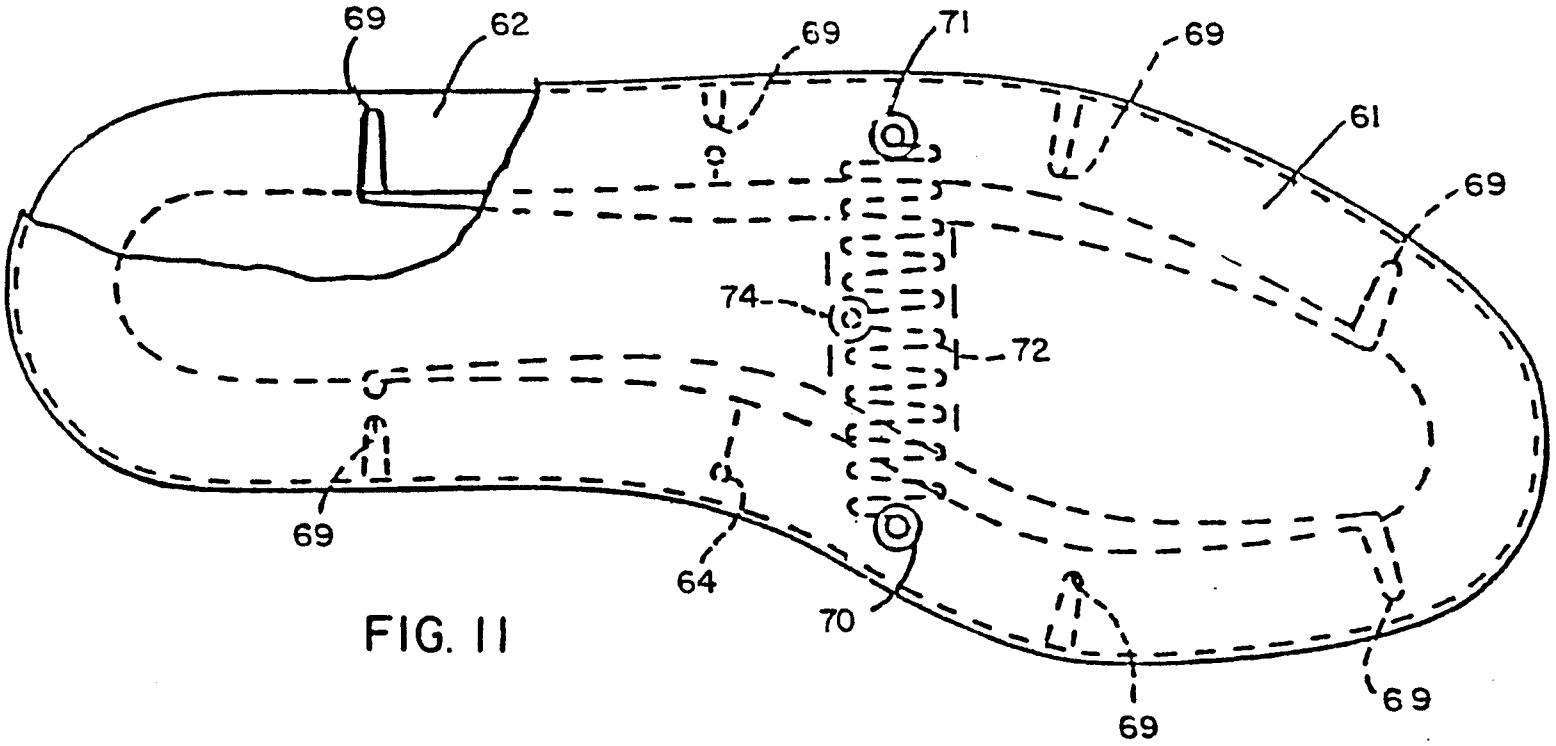
FIG. 11 is a plan view of the insole assembly of FIG. 9, including a transversely deformable frame, insole and socklining cover for same, as well as typical widthwise adjusting mechanism for deforming said frame.

FIGS. 8–11 describe another embodiment of this invention. In this embodiment the inner assembly comprises lining 46, insole assembly cover 50, and frame assembly 60, to which a spring 72 is attached. FIG. 8 shows a side view of the shoe in which lining 46 is preferably of a lining material having stretchability predominantly in one direction, namely that which will correspond to the longitudinal axis of the finished shoe. A typical preferred material for lining 46 would be the DRI-LEX® 2 Zone Comfort Lining material distributed by the Faytex Corp., of Braintree, Mass. FIG. 8 further shows lining 46 cement attached along its lower peripheral edges to lower peripheral edge of insole assembly cover 50, which has been preferably dip-molded of rubber or similarly stretchable plastic, or is cut from sheet rubber or plastic, and which in turn is supported by a nonstretchable insole 62 and filler block 68, with upper 22 having been lasted over permanent conventional insole 70. As best seen in FIG. 11, the frame assembly 60 comprises an articulated frame 61 which forms the base of the means for girth adjustment. Frame 61 is made of a suitable material such as plastic, preferably extruded polypropylene of about 0.03" to about 0.04" thickness, notched at 69 to allow the narrow bridging areas resulting from such notching to act as hinges to allow the frame to deform or distort transversely against tension supplied by a preferably stainless steel spring 72 attached thereto by means of fasteners 70 and 71, all of which comprise the frame assembly. Optionally, the bridging area can be omitted and the frame segmented with spaces therebetween and/or substantially shortened or limited in number. Spring 72 is optionally also attached to socklining supporting insole 62 and filler block 68at, a central position by fastener 74, to help keep frame deformation transversely in balance. Socklining 50 is provided with an extending peripheral margin, which is wrapped over the underlying frame 61, and joined to the underside thereof by a suitable means such as adhesive cement or a radiation bonding means. Then, with the upper 22 on a last, and a temporarily jig holding the frame in its outermost position, the liner 46 is preferably cement lasted to the bottom side of the socklining 50 so as to attach it to the frame assembly, and the jig removed. As shown the liner 46 is also attached to the upper 22 by a suitable means such as stitching or a cement adhesive. The upper 22 is then lasted in a conventional manner over a conventional insole 70 and, finally, the bottom edges are roughed and attached to the unit sole preferably using an adhesive, as shown, with all the usual other sole assembly options available if desired. FIG. 9 shows the shoe construction of FIG. 8 in a non-loadbearing condition, while FIG. 10 shows the same shoe in a loadbearing condition, as it would appear on a foot of somewhat less than the maximum girth said shoe is designed to accommodate. Optionally and preferably a socklining, insert, or footbed assembly (not shown) is removably positioned within the shoe directly over insole assembly cover 50.

Figure 13:
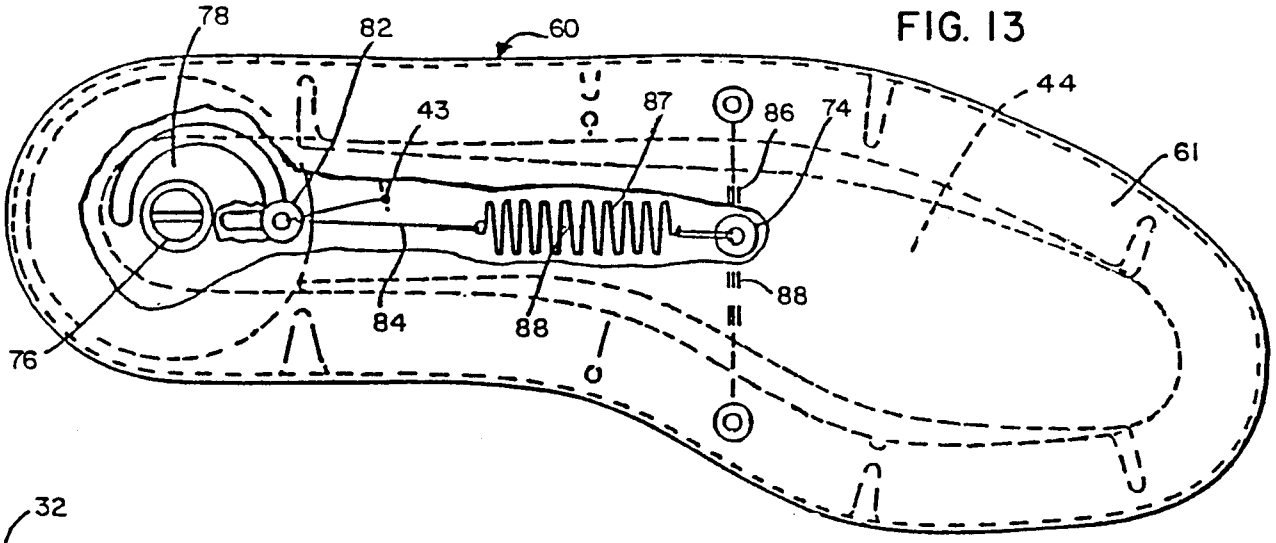
FIG. 13 is a cut-away plan view of the insole assembly of the shoe of FIG. 12.
Figure 12:
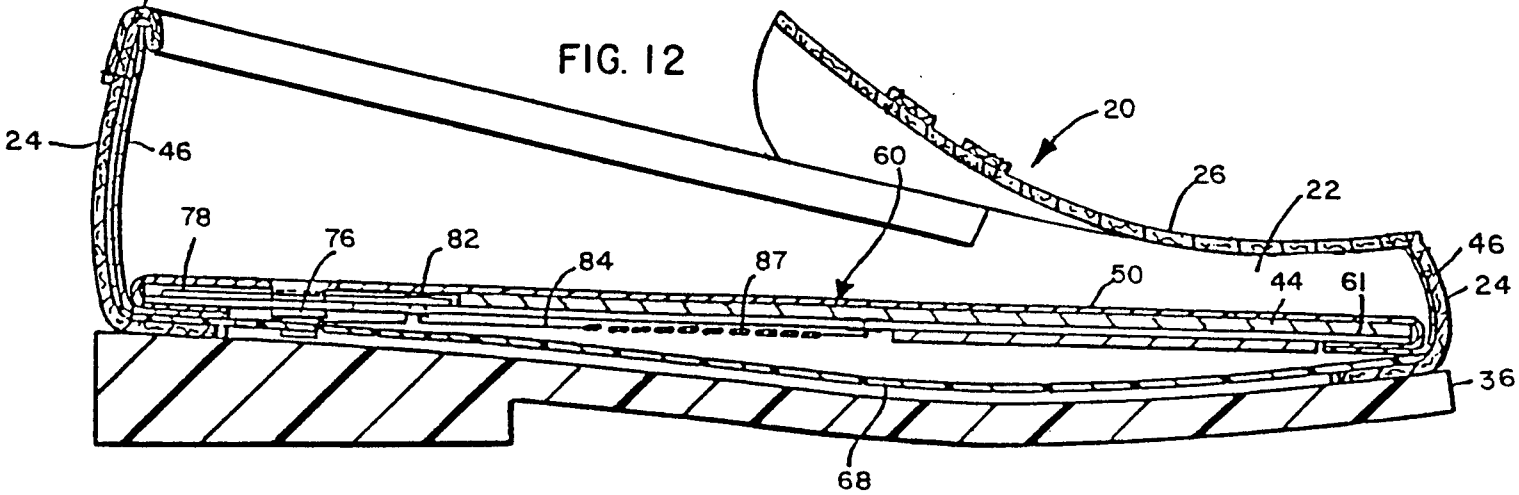
FIG. 12 is a side-elevational, cross-sectional view of still another version of a shoe with a deformable frame embodying principles of the present invention.

FIGS. 12 and 13 show a further embodiment of the invention, which functions as that in FIGS. 8–11, except that the adjustment means shown in FIGS. 12–13 includes a cam 78, manually rotationally adjustable from inside of the shoe for adjusting the tension of the spring 87, the back end of which leads through cam follower 82 and is attached to insole 44 at fastening point 43. Cables from the forward end of the spring will cause the girth of the lining assembly and thereby the shoe to self-adjust to fit feet of differing girths, while turning cam 78 by screw 76 causes the cam follower 82 to move according to the varying radius of cam groove 80 to adjust the effective tension exerted by spring 87. The cam follower 82 also engages a longitudinally oriented metal plate fastened to the underside of the insole to limit the cam follower to longitudinal movement. Optionally, and as shown, this plate could be designed to extend to grommet 74 and thereby stiffen the insole between follower 82 and grommet 74 to prevent longitudinal buckling of insole 44 during girth adjustment.

If the spring is eliminated from the above assembly, and the cables extend from the grommet directly along dashed line 88, and through cam follower 82 to end fastening point 83, the adjustment becomes completely manual, with the manual adjustment of the cam determining the distance between opposing side segments of frame 61. Alternatively, but not shown, transverse spring 72, shown in FIG. 11, could be included in this embodiment, to allow automatic girth adjustment together with manual adjustment. Optionally, a similar adjustment spring and/or cam could be placed in the waist area to eliminate the cables.

Figure 14:
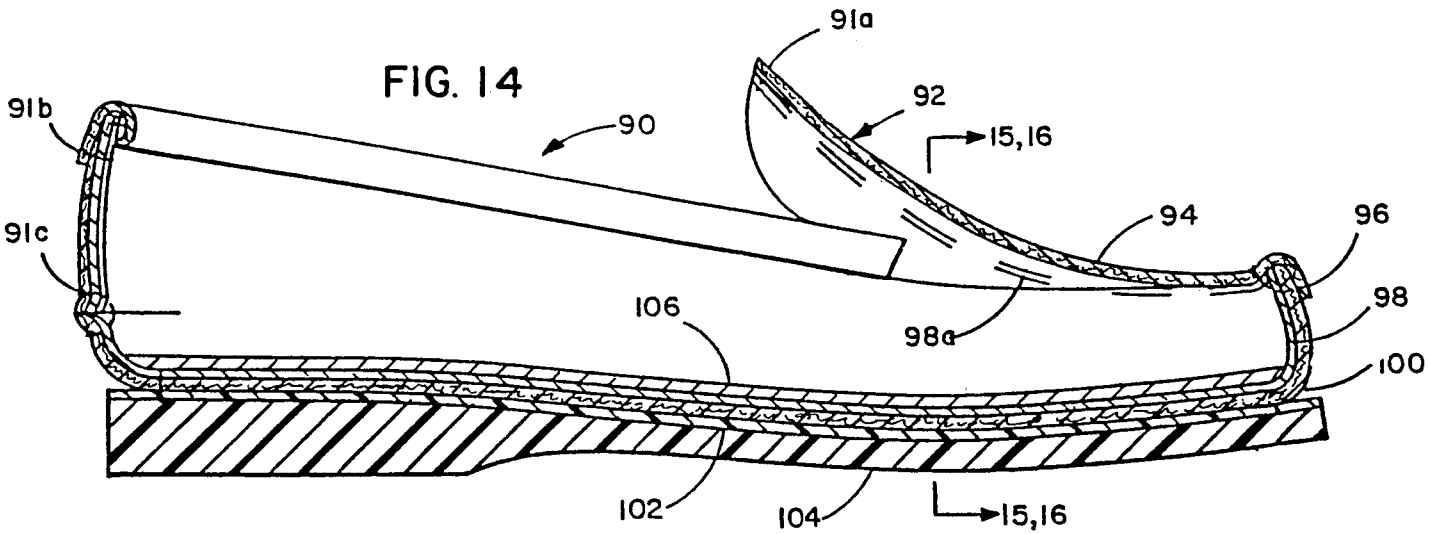
FIG. 14 is a side-elevational cross-sectional of another preferred embodiment of the shoe incorporating principles of the present invention.
Figure 16:
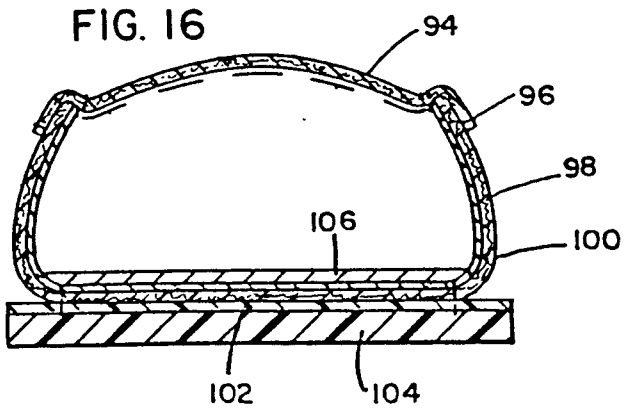
FIG. 16 is a transverse cross-sectional view of the shoe of FIG. 14, taken along the line 16—16 thereof, and showing the section as it would appear, on a foot of the greatest girth accommodated by this shoe.
Figure 15:
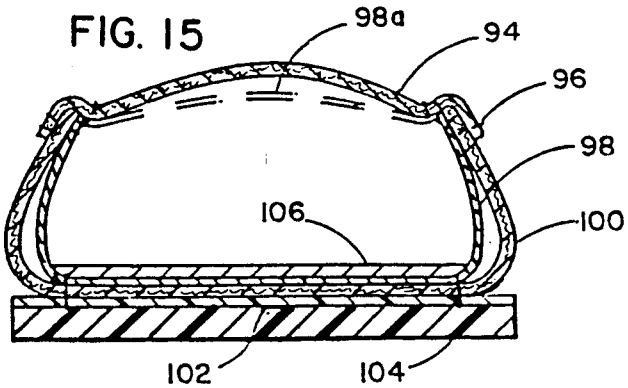
FIG. 15 is a transverse cross-sectional view of the shoe of FIG. 14, taken along the line 15—15 in the latter, and showing the section as it would appear, on a foot of a lesser girth in the girth range accommodated by this shoe.

FIGS. 14 through 16 show a still further embodiment of the invention, which functions in a manner similar to those of the previous embodiments but with some differences in construction designed to allow this embodiment to be produced at somewhat lower cost for use when the cost factor is a critical and determining issue. FIG. 14 shows shoe 90, typically but not limited to a moccasin loafer style of tubular construction, having an upper 92 of leather or other suitable upper material, comprising a plug or tip 94, preferably attached by handsewn overlap seam 96 to vamp 100, vamp lining 98 and optional plug lining **98*a*. The linings are constructed of a suitable material which is stretchable girthwise such as spandex, or other like materials, particularly the heavier and more durable Spandura® products distributed by H. L. Warshow & Sons, Inc. of New York City, N.Y. The linings 98 and optional 98*a* are preferably firmly fastened to upper 92 at a number of locations in the shoe. As shown, fastening occurs at plug stitching 91, optional plug lining stitching 91*a*, cuff stitching 91*b*, kicker handsewn seam 91*c*, and also, where lining 98 is fastened, together with vamp 100 midsole 102 by the conventional Littleway® stitching (not shown). Unitsole 104 is attached to midsole 102 by the customary adhesive cement, with both midsole 102 and unitsole 104 composed of the conventional sheet or molded materials used for such members such as leather, plastic or rubber. Finally, a sock 106 is removably inserted into shoe 90**, to improve the comfort and durability of the final product.

FIG. 15 shows the shoe as it would appear when worn on a foot requiring little or no girth adjustment of the shoe. The upper 100 and linings 98 and **98*a*** are in close contact at and near their mutual points of attachment, allowing the sides of the upper, and optionally the top of the upper to deform in both height and width to accomodate the foot of the wearer.

As shown in FIG. 16, the linings 98 and **98*a*** have been urged into full contact with the upper and plug, which exhibit essentially zero deformation of contours from those of the last, or form, on which the shoe was made. This drawing shows the position of the members of the shoe as they would appear when accomodating a foot having substantially the maximum girth for which the shoe is designed to fit.

While the lining 98 and **98*a*** are preferably composed of elastically stretchable fabric materials optionally other materials, or mechanisms may be used to create variable and adjustable volumes between foot and upper, operating as girthwise adjustment means at least in the ball region of the shoe. These include sealed or sealable plastic or similar bladders for containment of varying amounts of air and/or other gasses, gels, 'flo' materials or resilient plastic foams. Such foams include the closed cell heat-moldable polyester based polyurethane foams distributed by United Foam Products Corp. of Georgetown, Mass., and others, and are preferably of low density, i.e. 2#/cubic foot or less. Alternatively, such foams can be used to contribute to the elasticity of the girth adjustment means. In such an embodiment the foam is preferably lined with a somewhat elastic inner lining of fabric or even a flocking material. Such linings to function properly for appreciable girthwise adjustability should provide at least one full standard 'width' adjustment which means at least about 3/16" of girth adjustability at the ball, waist, and instep of the foot. To achieve such adjustability and proper compression rate the linings should be thicker than the 1/16" and ⅛" fabric-to-foam lining materials often used in vamp linings; i.e. initially in the about ⅜" to ½" thickness range. Such thickness would usually cause unacceptable gaping or open space between the topline of the shoe and the foot adjacent thereto, but this gaping tendency however, can be minimized or even eliminated by proper contouring of the thick foam, reducing the thickness at the top-line thereof in the ball, waist, and instep areas for a better appearance and closer fit between shoe and foot. It is a further embodiment of the invention to provide such contouring means for foam lining elements used in shoes.

There are a number of known approaches for the contouring of such foam elements, including initial molding, removal of material by skiving and the like, and re-molding of slab or sheet foam materials. The preferred approach, however, involving the minimum equipment cost and the maximum adaptability to the widest possible range of shoe styles, involves the use of heatmoldable foams, including those mentioned herein, which can be permanently contoured when brought to temperatures of about 260° to 300° F. for about 8 to 12 minutes. This is most easily done by providing the shoe with the aforementioned heat-moldable knit fabric faced polyurethane foam sheet lining material, preferably of about ⅜" to ½" initial thickness overall, later contouring same on the otherwise finished shoe by inserting a last or other form into the shoe, such last or form having the contouring and girth dimensions of the least girth foot the shoe is designed to accommodate. After placing the last in the shoe, the proper heat is introduced by any of the known techniques, i.e. by use of a suitable oven, and/or by heating the lasts, as by circulating hot oil or other fluid therein. After cooling, the less compressed areas of the foam will continue to contribute to the girth adjustment of the shoe.

Still another optional embodiment (not shown) comprises the use of small leaf springs, inserted between lining and upper in the sides of the waist area of the shoe, to facilitate the adjustment of the girth of the shoe. Such springs, stamped out of thin, e.g. about 0.010 inches thick, flat spring shim stock can be pre-formed or bent to hold the plug (top of the upper) in a lower position with the sides of the upper deformed outward from that foot,as would be required by a foot of lesser girth. A foot of greater girth would urge the plug up, and the sides inward to a less extreme contour, against the gentle restraint of the spring means.

In all the above embodiments, it should be noted that shoes so made will automatically compensate for differences from the norm, in girth relationships between ball and instep. This offers significant fit advantages over conventional constructions, particularly for styles not having conventional girth adjustment means, e.g. loafers, boots, slip-on casuals, and the like.

What is claimed is:

1. A shoe having a toe, a midportion, and a heel portion comprising an at least partly deformable upper which is attached to a sole, said upper and sole forming a cavity into which a foot can be placed, and an adjustable inner assembly disposed within said cavity and attached to an upper portion of said upper, so as to extend along at least a portion of the sides of the upper, said inner assembly having a resiliently deformable portion which acts together with the said at least partly deformable upper to adjust the girth of the shoe in response to a force exerted thereon so as to fit feet of differing widths and girths.

2. The shoe of claim 1, wherein the resiliently deformable portion comprises an elastic material.

3. The shoe of claim 2, wherein the elastic material is an elastic sheet material.

4. The shoe of claim 1, wherein the resiliently deformable portion comprises a spring.

5. The shoe of claim 1, wherein the resiliently deformable portion comprises a frame assembly containing a spring having tension attached thereto to facilitate its resilient deformation.

6. The shoe of claim 5, further comprising an insole disposed within the shoe cavity and adjacent the adjustable inner assembly.

7. The shoe of claim 6, containing tension adjustment means for adjusting the tension of the spring.

8. The shoe of claim 7, wherein said adjustment means is a manual tension adjustment means.

9. The shoe of claim 1, wherein at least a portion of the inner assembly comprises a relatively non-stretchable material.

10. The shoe of claim 1, wherein said inner assembly includes a frame member articulated to allow transverse movement of portions of said frame.

11. The shoe of claim 10, wherein said frame member extends from about the toe to about the heel of the shoe.

12. The shoe of claim 10, wherein said frame member is located at the mid-portion of the shoe.

13. The shoe of claim 1, wherein the upper contains an expandable seam.

14. The shoe of claim 1, wherein the inner assembly comprises a liner extending along at least the sides of the upper and a resiliently deformable member extending along the bottom of the shoe cavity.

15. The shoe of claim 1, wherein the inner assembly is partially suspended in the cavity when the shoe is not on the foot.

16. The shoe of claim 1, wherein the inner assembly is composed at least in part of elastic sheet material.

17. The shoe of claim 16, wherein said elastic sheet material is, at least in part, of spandex fabric.

18. The shoe of claim 1, wherein the inner assembly has side portions and a bottom portion and wherein the inner assembly is composed at least in part of a plastic foam.

19. The shoe of claim 18, wherein the plastic foam comprises at least a portion of the side portions.

20. The shoe of claim 19, wherein said foamed side portions are contoured.

21. The shoe of claim 1, wherein the inner assembly is attached to the upper by means of a spring.

22. The shoe of claim 21, wherein the spring is located in the mid-portion of the shoe.

* * * * *